US006675772B1

(12) United States Patent
Mingo et al.

(10) Patent No.: US 6,675,772 B1
(45) Date of Patent: Jan. 13, 2004

(54) METHOD AND SYSTEM FOR CONTROLLING AN INTERNAL COMBUSTION ENGINE WHEN SUCH ENGINE LOSES A PRIMARY CRANKSHAFT POSITION SENSOR

(75) Inventors: Paul Charles Mingo, Farmington Hills, MI (US); William Russell Goodwin, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/065,130

(22) Filed: Sep. 19, 2002

(51) Int. Cl.[7] ..... F02P 7/00; F02D 41/22
(52) U.S. Cl. ..... 123/406.18; 123/479; 701/114
(58) Field of Search ..... 123/406.18, 406.58, 123/479; 701/107, 114

(56) References Cited

U.S. PATENT DOCUMENTS

| | | | | | |
|---|---|---|---|---|---|
| 4,690,123 | A | | 9/1987 | Kimura et al. | 123/609 |
| 4,757,798 | A | | 7/1988 | Sasaki | 123/643 |
| 4,960,092 | A | | 10/1990 | Sasaki et al. | 123/406.18 |
| 5,060,614 | A | | 10/1991 | Uchimi et al. | 123/406.18 |
| 5,186,144 | A | | 2/1993 | Fukui | 123/406.58 |
| 5,209,202 | A | * | 5/1993 | Maurer et al. | 123/406.18 |
| 5,239,962 | A | | 8/1993 | Fukui et al. | 123/406.18 |
| 5,584,274 | A | * | 12/1996 | Fukui et al. | 123/406.18 |
| 5,632,246 | A | * | 5/1997 | Fukui et al. | 123/406.18 |
| 5,671,145 | A | | 9/1997 | Krebs et al. | 701/102 |
| 5,816,218 | A | | 10/1998 | Motose | 123/406.18 |
| 6,546,911 | B1 | * | 4/2003 | Fayyad et al. | 123/479 X |

* cited by examiner

*Primary Examiner*—Tony M. Argenbright
(74) *Attorney, Agent, or Firm*—Daly, Crowley & Mofford, LLP; Julia Voutyras; Allan J. Lippa

(57) ABSTRACT

A method and system for controlling an internal combustion engine system upon loss of a crankshaft position sensor signal produced by such system is provided. The method includes providing a control module having a central processing unit and a time processor unit associated with such central processing unit. The time processor unit has programmed into is a first code for operating the engine system in the presence of a proper crankshaft position sensor signal. The control module stores a second code for loading into the time processor unit to operate the engine system with the time processor unit upon detection of an improper crankshaft position sensor signal. Initially, the engine system is operated with the time processor unit executing the first code. The method monitors the crankshaft position signal for a fault. Upon detection of the fault, the method loads the second code into the time processor unit and operates the engine system with the time processor unit executing the second code.

7 Claims, 3 Drawing Sheets

METHOD AND SYSTEM FOR CONTROLLING AN INTERNAL COMBUSTION ENGINE WHEN SUCH ENGINE LOSES A PRIMARY CRANKSHAFT POSITION SENSOR

BACKGROUND OF INVENTION

This invention relates generally to engine control systems, and more particularly to engine control systems adapted for controlling an engine upon loss of such engine's primary crankshaft position sensor.

As is known in the art, on modern internal combustion engines, engine speed and position is determined by a sensor reading mechanical features on the rotating crankshaft, often called a crankshaft position sensor (CKP). Upon failure of this sensor or the associated wiring, the electronic system does not have necessary signal information. In many cases, this results in an inability to run the internal combustion engine. In some cases, a second position sensor, like a camshaft position sensor, can be utilized to provide engine operation albeit at a reduced function level.

More particularly, the crankshaft position sensor (CKP) provides highly accurate information to the Powertrain Control Module (PCM) and is utilized by the internal software in providing proper operation of the internal combustion engine. Upon failure of this sensor, the software will either be unable to work, thus disabling engine operation; or, in some systems, the software will provide use of other sensor inputs to run the engine under these different sensor inputs, usually, however, at a reduced function level.

The inventors have recognized a method for correcting for the loss of the primary crankshaft position sensor for a Powertrain control module having a Central Processing Unit (CPU) which includes the use of one or more Time Processing Units (TPUs). Initially, the CPU loads a first, normal engine operating program stored in the CPU memory into the TPU memory. The TPU uses the first computer program to control the engine in the absence of detection of a failure in primary crankshaft position sensor. Upon detection of a failure, the CPU loads a second program stored in the CPU memory into the TPU memory. The TPU executes the second program loaded into the TPU memory to thereby control the engine upon the loss of such engine's primary crankshaft position sensor.

More particularly some Powertrain Control Modules (PCM) for Internal Combustion Engines utilize Central Processing Unit (CPU) Architectures with Time Processing Units (TPU) which perform key calculation and control functions. These TPUs provide efficient means of performing calculation intensive functions. These TPU units typically contain relative small amounts of RAM space, which limits program size allowable on the TPU. A key feature of the TPU is its proactive approach to handling events and the resulting fine resolution achieved for waveform generation and measurement. The TPU consists of a single microsequencer and dedicated channel hardware (there are 16 channels). The microsequencer prepares the channel-specific hardware to react to possible future events. When a particular event actually occurs, the hardware autonomously performs some action and requests microsequencer servicing. Because the hardware is autonomous, the usual latency penalties associated with an undedicated microsequencer are not incurred. The microsequencer responds to the service request (after servicing any existing requests based on an optimized scheduling mechanism) and prepares the channel hardware for the next event. Further description of a time processor unit (TPU) is in "TPU Time Processor Unit Reference Material" published by Motorola, Inc., 1996 the entire subject matter thereof being incorporated herein by reference.

In some configurations, these TPU segments are used to control Electronic Ignition, Fueling and other functions. These functions often have significant calculation and control requirements and the software size requirements for normal function do not allow sufficient memory size to provide for special functions, like compensating for partial system failure. One situation is to provide continuing operation under system failure conditions, like a crankshaft position sensor failure.

In accordance with the present invention, a method for controlling an internal combustion engine system upon loss of a crankshaft position sensor signal produced by such system is provided. The method includes providing a control module having a central processing unit and a time processor unit associated with such central processing unit. The time processor unit has programmed into it a first code for operating the engine system in the presence of a proper crankshaft position sensor signal. The control module stores a second code for loading into the time processor unit to operate the engine system with the time processor unit upon detection of an improper crankshaft position sensor signal. Initially, the engine system is operated with the time processor unit executing the first code. The method monitors the crankshaft position signal for a fault. Upon detection of the fault, the method loads the second code into the time processor unit and operates the engine system with the time processor unit executing the second code.

In accordance with the present invention, in a normal engine operating mode (i.e., with proper crankshaft position signals), standard engine operating software is loaded to the TPU. In a failure mode management mode, (i.e., upon detection of an improper crankshaft position signals), special compensation software is loaded into and executed by the TPU.

In one embodiment, the engine operator initiates power to the PCM, usually through turning the key in the ignition switch. The PCM loads normal operation software into the necessary TPUs for engine operation (assuming no parameters were noting special software loads needed). The PCM determines the crankshaft position sensor is not providing a proper signal and sets a parameter to indicate the crankshaft position sensor is failed. The operator turns the PCM power "off " by turning the ignition key to an "off" position. The operator turns the ignition key back "on" providing the power to the PCM a second time. Upon initialization, the PCM recognizes the crankshaft position sensor (or other system) has failed. The PCM loads special software to the TPU to compensate for the failed sensor (or other system). The engine can then be operated, possibly at a reduced function level.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like reference symbols in the various drawings indicate like elements.

DETAILED DESCRIPTION

Figure 1:
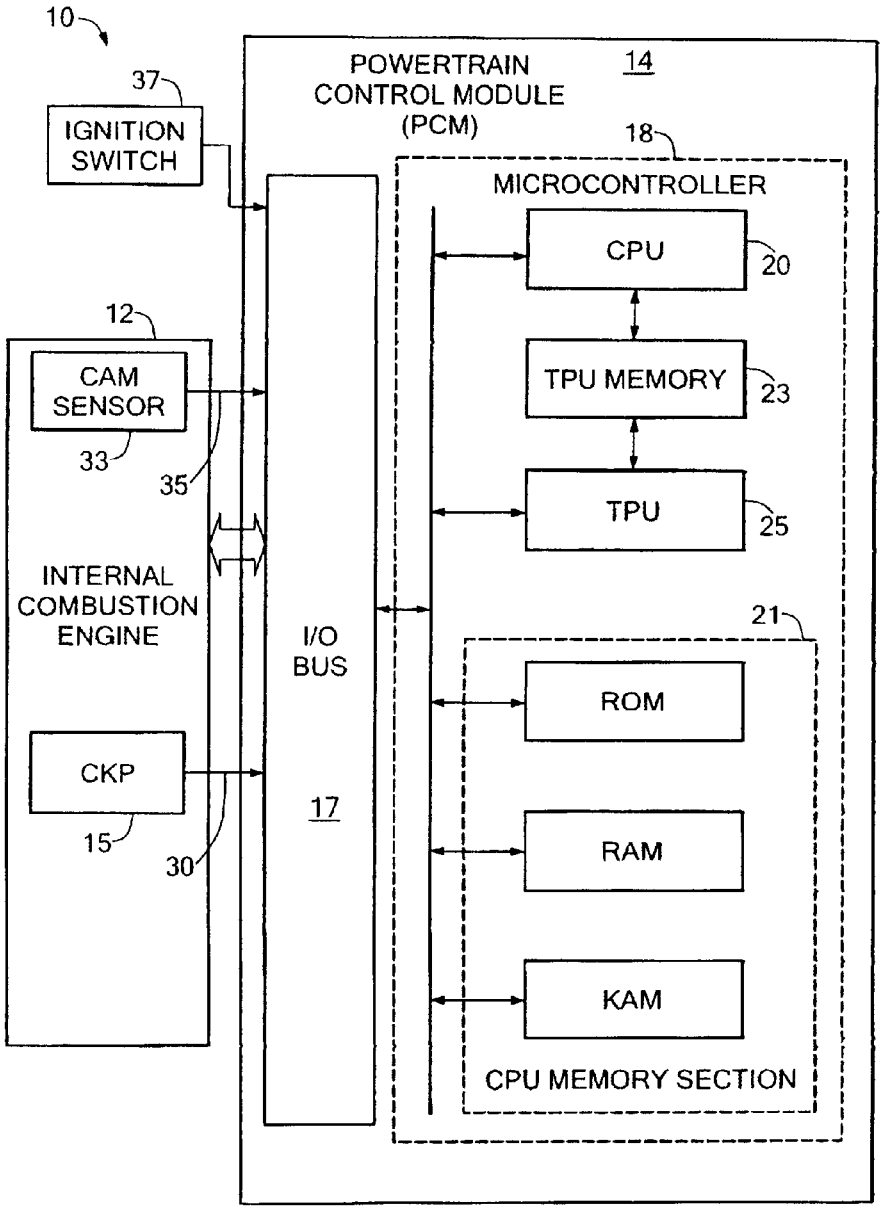
FIG. 1 is a diagrammatical block diagram of an engine system according to the invention.

Referring now to FIG. 1, an internal combustion engine system 10 is shown. The engine system 10 includes an internal combustion engine 12 coupled to a powertrain control module (PCM) 14. The module 14 includes a microcontroller 18 having a central processing unit (CPU) 20, a CPU memory section 21, a time processor unit (TPU) 25, and a TPU memory 23. The TPU 25 is described in "TPU Time Processor Unit Reference Material" published by Motorola, Inc., 1996, referred to above. The CPU memory section 21 includes a random access memory (RAM), a read-only-memory (ROM) and other common memory chips, such as a keep-alive memory (KAM) as indicated. The engine 12 includes a crankshaft position (CKP) sensor 15 that provides a crankshaft position signal on line 30 for the PCM 14. It is understood that other signals are produced by the engine 12 for the PCM 14 and in response to such signal the PCM 14 produces fuel and timing signals, in addition to other control signals for the engine 12 via I/O bus 17.

Figure 2:
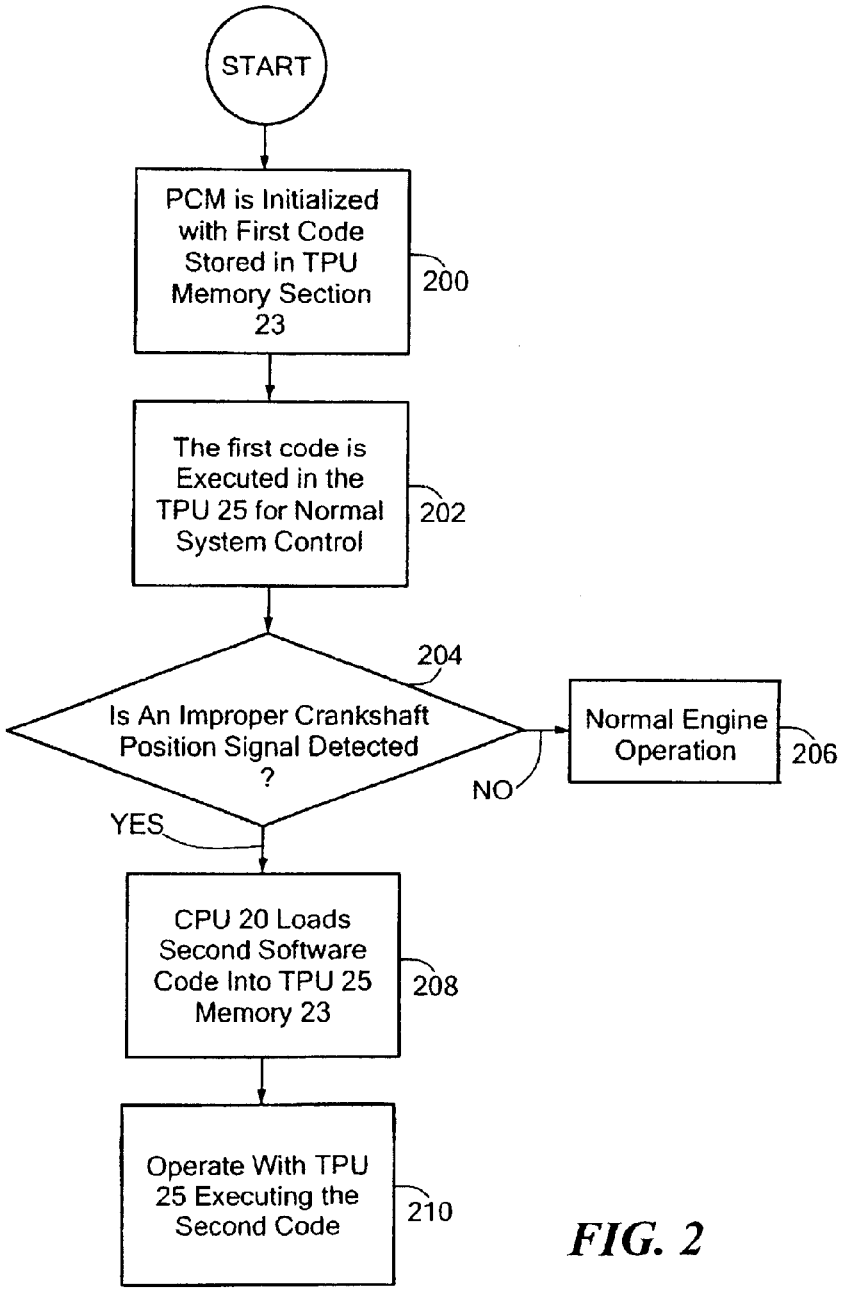
FIG. 2 is a flow diagram showing the process used to control the engine system of FIG. 1.

Referring to FIG. 2, the process for controlling engine 12 (FIG. 1) is shown. The PCM 14 is initialized with software having a first code for operating the engine system 12 in the presence of a proper crankshaft position sensor signal on line 30, Step 200. The first code upon execution by the PCM 14 operates the engine system 10 in the presence of a proper crankshaft position sensor signal on line 30.

Thus, in Step 200, the PCM 14 is initialized with the first code stored in the TPU memory 23. In Step 202, this first code is executed in the TPU 25 for normal system control.

It is noted that the control module (PCM 14) stores in ROM of the CPU memory section 21 a second software code for loading into the TPU memory 23 to operate the engine system 10 with the time processor unit (TPU 25) upon detection of an improper crankshaft position sensor signal on line 30.

In Step 204, the CPU and/or TPU 25 monitors and examines the crankshaft position signal on line 30. Typically, a deficient crank sensor signal will be identified by using a comparison of the measured crankshaft sensor signals to the camshaft sensor signals. If there is no indication of an improper crankshaft control signal on line 30 (i.e., proper comparison signals are present) the engine system proceeds with normal operation, Step 206.

Upon detection of the fault, the method activates the CPU to load a second software code into the time processor unit (TPU 25) memory 23 in Step 208. In Step 210, the engine system 10 operates with the time processor unit (TPU) 25 executing the second code. Thus, upon detection of a primary crankshaft position sensor fault, the CPU 20 loads a fail-safe program stored in the CPU memory section 21 into the TPU memory 23. The TPU 25 executes the fail-safe program (i.e., the second software code) loaded into the TPU memory 23 to thereby control the engine 10 upon the loss of such engine's primary crankshaft position sensor.

The second code, in this example, uses the camshaft sensor 33 as the primary position sensor. This cam sensor 33 signal on line 35 provides information which will then be used to provide fueling and spark placement control to allow the engine to continue operation. Due to reduced signal content typically provided cam sensor 33, there will be reduced accuracy of the control and thus reduced function when compared to a system run on the crankshaft sensor signals.

Figure 3:
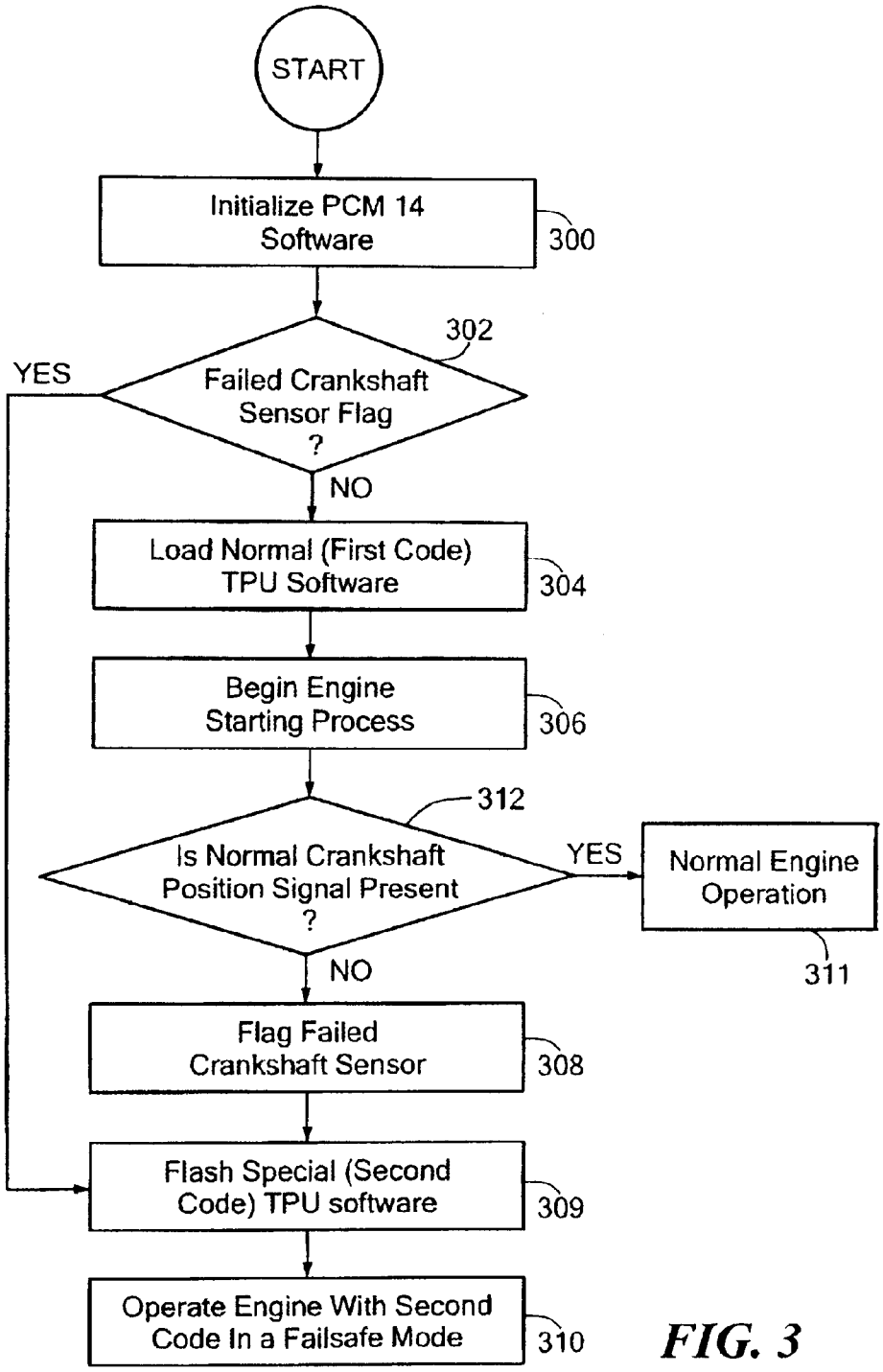
FIG. 3 is a more detailed block diagram of the process used to control the engine system of FIG. 1.

Referring to FIG. 3, a more detailed flow diagram is shown in the process used to control the engine 12. In Step 300, the PCM 14 (FIG. 1) is initialized with software for normal engine operation. In Step 302, the PCM 14 checks for a crankshaft sensor signal "failed" flag produced by the CPU 20. If there is no flag present, the CPU 20 loads normal (i.e., first code) software into the TPU memory 23 (Step 304) and the normal engine starting process begins (Step 306); otherwise, if there is a flag present the second code is loaded into the TPU 25 memory 23 (Step 309), and the engine 12 operates with the second code in a fail safe mode (i.e., with the cam sensor 33 signal on line 35), Step 310.

As noted above, in the typical case the CPU 20 loads normal (i.e., first code) software into the TPU 24 memory 25 (Step 304) and the normal engine starting process begins (Step 306). The PCM 14 monitors the crankshaft sensor signal on line 30, Step 312. If no abnormality is detected in the crankshaft sensor signal on line 30, normal engine operation continues using the crankshaft sensor 15 signal on line 30. If, on the other hand, an abnormality is detected, the CPU 20 produces a failed crankshaft sensor flag and stores it in keep alive memory (KAM), Step 308, and the second code (a code for enabling failsafe operation of the engine 12 using the cam sensor 33 signal on the 35) is loaded into the TPU 25 memory 23, step 309. The engine 12 operates with the second code in a failsafe mode, Step 310.

More particularly an operator starts the engine 12 by turning an ignition key 37, FIG. 1. In response to detection of such ignition, the PCM 14 initiates a sequence of control signal to start the engine 12. In the normal engine operating mode (i.e., with proper crankshaft position sensor 15 signal on line 30), standard engine operating software, the first code is loaded to the TPU 25 memory 23 (Step 302).

In a failure mode management mode, (i.e., upon detection of an improper crankshaft position signals), failsafe operation software (i.e., the second code, using the cam sensor signal on line 35) is loaded into the TPU memory 23 and executed by the TPU 25. More particularly, the engine operator initiates power to the PCM 14, usually through turning the key in the ignition switch 37. The PCM 14 loads normal operation software (i.e., the first code) into the TPU 25 memory 23 for engine operation (assuming no parameters were noting special software loads needed). If the PCM 14 determines the crankshaft position sensor 15 is not providing a proper signal on line 30, it sets a parameter to indicate the crankshaft position sensor 15 has failed. The operator turns the PCM power "off" by turning the ignition key 37 to an "off" position. The operator turns the ignition key 37 back "on" providing the power to the PCM 14 a second time. Upon initialization, the PCM 14 recognizes the crankshaft position sensor (or other system) has failed. The PCM 14 loads the failsafe software (i.e., second code) into the TPU 25 memory 35 to compensate for the failed sensor (or other system). The engine can then be operated using the cam sensor 33 signal on line 35, albeit possibly at a reduced function level. Due to the reduced accuracy there would likely be a restriction on the max RPM and spark timing would be placed conservatively for each spark event, for example, 10 degrees before Top Dead Center (TDC) instead to 20 to 30 degrees before TDC.

A number of embodiments of the invention have been described. Nevertheless it will be understood that various modifications may be made without departing from the spirit and scope of the invention. For example, while the invention has been described for use when a crankshaft position signal fails, it may be used if some other engine sensor fails, or for systems other then engine systems. Accordingly, other embodiments are within the scope of the following claims.

What is claimed is:

1. A method for controlling a system upon loss of a sensor signal produced by such system, such method comprising:

providing a control module having:

a central processing unit; and a time processor unit associated with such central processing unit, programming in the time processor unit a first code for operating the system in the presence of a proper sensor signal;

storing in the control module a second code;

initially operating the system with the time processor unit executing the first code;

monitoring the sensor signal for a fault; and upon detection of the fault, having the central processing unit load the second code into the time processor unit and operating the system with the time processor unit executing the second code.

2. The method recited in claim 1 wherein the system is an internal combustion engine system.

3. The method recited in claim 1 wherein the sensor signal is a crankshaft position sensor signal.

4. The method recited in claim 3 wherein the system includes a camshaft sensor signal and wherein when a fault is detected the second code operates the engine with the camshaft sensor signal.

5. An internal combustion engine system, comprising:

a sensor;

a control module having a central processing unit and a time processor unit associated with such central processing unit, the time processing unit having programmed therein a first code for operating the engine system in the presence of a proper sensor signal, the control module storing a second code for loading into the time processor unit to operate the engine system with the time processor unit upon detection of an improper sensor signal;

the central processing unit being programmed to initially operate the engine system with the time processor unit executing the first code;

the control module having code for monitoring the sensor signal for a fault; and upon detection of the fault, the central processing, unit loads the second code into the time processor unit and operating the engine system with the time processor unit executing the second code.

6. The system recited in claim 5 wherein the sensor is a crankshaft position sensor.

7. The system recited in claim 6 including a camshaft sensor signal and wherein when a fault is detected the second code operates the engine with the camshaft signal.

* * * * *